United States Patent [19]

Ennis, Jr. et al.

[11] Patent Number: 4,544,979

[45] Date of Patent: Oct. 1, 1985

[54] AUTOMATIC CURRENT LEAD RETRACTOR SYSTEM FOR SUPERCONDUCTING MAGNETS

[75] Inventors: Robert M. Ennis, Jr.; D. Michael Coffey, both of Oak Ridge; R. Wayne McGhee, Jacksboro, all of Tenn.

[73] Assignee: Cryomagnetics, Inc., Oak Ridge, Tenn.

[21] Appl. No.: 592,342

[22] Filed: Mar. 22, 1984

[51] Int. Cl.[4] ..... H01F 7/22

[52] U.S. Cl. ..... 361/19; 335/216; 361/141

[58] Field of Search ..... 361/19, 141; 335/216; 174/15 CA

[56] References Cited

U.S. PATENT DOCUMENTS

| | | | |
|---|---|---|---|
| 3,839,689 | 10/1974 | Biltcliffe et al. | 335/216 |
| 4,369,636 | 1/1983 | Purcell et al. | 335/216 X |
| 4,453,149 | 6/1984 | Rios | 335/216 |

FOREIGN PATENT DOCUMENTS

| | | | |
|---|---|---|---|
| 2901892 | 7/1980 | Fed. Rep. of Germany | 335/216 |
| 127005 | 10/1980 | Japan | 335/216 |

*Primary Examiner*—Harry E. Moose, Jr.
*Attorney, Agent, or Firm*—Pitts and Brittian

[57] ABSTRACT

An automatic current lead retraction system for superconducting magnet installations. An automatic current lead retraction system utilizes an operator wherein either hydraulic or pneumatic cylinders bring about electrical contact of the current leads or the separation thereof as well as a safety shorting switch for the system. By using the pneumatic or hydraulic cylinders and all non-magnetic materials, there is no influence upon the magnetic field created by the superconducting magnet. Provision is made to monitor the condition of the magnet to be certain that it is in a persistent mode before the current leads are retracted. Furthermore, safety signals are generated to assure that no current is flowing at the time of retraction, that the resistance across the contacts is sufficiently low when engaged and that all electrical, air/hydraulic fluid systems are functioning properly before operation of the retracting system. Overall control is achieved using a microprocessor. If desired, the entire system can be operated by a program inserted into an appropriate computer.

12 Claims, 3 Drawing Figures

AUTOMATIC CURRENT LEAD RETRACTOR SYSTEM FOR SUPERCONDUCTING MAGNETS

DESCRIPTION

1. Technical Field

This invention relates generally to superconducting magnet systems and more particularly to an automatic system for safely retracting the current leads connecting a power supply to such superconducting magnets.

2. Background Art

Superconducting magnets are magnets which operate at sufficiently low temperatures that the material from which the windings are manufactured exhibits substantially no resistance. Typically, these magnets operate on the order of 4.2 degrees Kelvin. For operation, the magnets are initially connected to a suitable power source or power supply using current leads such that a desired current flow is established through the magnet windings. The magnet has a "persistent" switch built therein, as known in the art. This is a segment of winding material that connects across the magnet input leads that is either resistive or superconducting depending upon temperature. During the charging of the magnet from the power supply, the persistent switch is heated. When the desired current flow is established, the heater is turned off, thus causing the persistent switch to become a superconductor to create a short across the magnet input. This allows the power supply to be turned off and the current continues to flow in the magnet and persistent switch. At this point, the current leads to the magnet can be removed. This removal is necessitated because one end of the leads is operating at the extremely low temperature of the magnet and the other end at substantially room temperature (e.g., 300° K.). Even though the leads are cooled with appropriate means, they present a significant heat input to the system and thus to the potential boil-off of the material utilized to maintain the temperature of the magnet, (e.g., liquid helium).

The current state-of-the-art for the removal of these leads is to physically disconnect the same by a technician. There are numerous problems associated with this type of disconnect in that the technician must be assured that the magnet is in a persistent mode such that current flow through the leads can be and has been interrupted. Furthermore, there may be significant radiations emitted from the magnet because of its prior or anticipated use such that there is some danger to the technician during the disconnect step. Still another potential problem occurs if a superconducting magnetic switches to a non-superconducting mode, i.e, "quenches". The energy of the magnet is then dissipated which may result in destruction of the persistent switch or transfer into the current leads. If such should occur during the removal of the leads, serious injury to an individual performing the disconnect could occur. Occasionally significant problems have existed during the disconnect procedure and "near misses" of injury are known to have existed.

Accordingly, it is desired to provide a system which will automatically produce the disconnect of the current leads to a superconducting magnet in the absence of the physical presence of an operator at the point of disconnect.

It is a further object of the present invention to provide an automatic disconnect system which does not affect in any way the magnetic field produced by the magnet.

It is still another object of the present invention to provide a system which determines that the magnet is in the persistent mode and the disconnect can be accomplished safely.

It is also an object of the present invention to determine other characteristics of the current lead/magnet in connection and/or disconnecting such as the quality of the contact between same as well as the absence of current flow in the leads prior to performing the disconnect.

It is still another object of the present invention to include safety controls which will prevent operation if there is loss of power to the controller, if there is a loss of the persistent mode or any other condition which would potentially affect the safety of the combined systems.

Other objects and advantages of the present invention will become apparent upon a consideration of the following detailed description with reference to the drawings.

DISCLOSURE OF THE INVENTION

According to the present invention, there is included a non-magnetic, and non-magnetic field producing disconnect unit employing hydraulic or pneumatic fluids to bring about connection to, or disconnect from, a superconducting magnet of the leads required for introducing appropriate current flow into the magnet during startup. Coupled with this disconnect unit, through appropriate interfacing, is a microprocessor which can be appropriately programmed to safely accomplish the connection or disconnection of the current leads to the magnet. Signals to the microprocessor include, but are not limited to, the condition of the operation of the magnet, the quality of pressure to the hydraulic/-pneumatic operator, power to the controller, and the quality of the contact of the leads. Also, a safety switch is provided to shunt the persistent switch of the magnets. In this manner, a significant degree of safety is achieved principally when disconnecting current leads to a superconducting magnet.

BEST MODE FOR CARRYING OUT THE INVENTION

Figure 1:
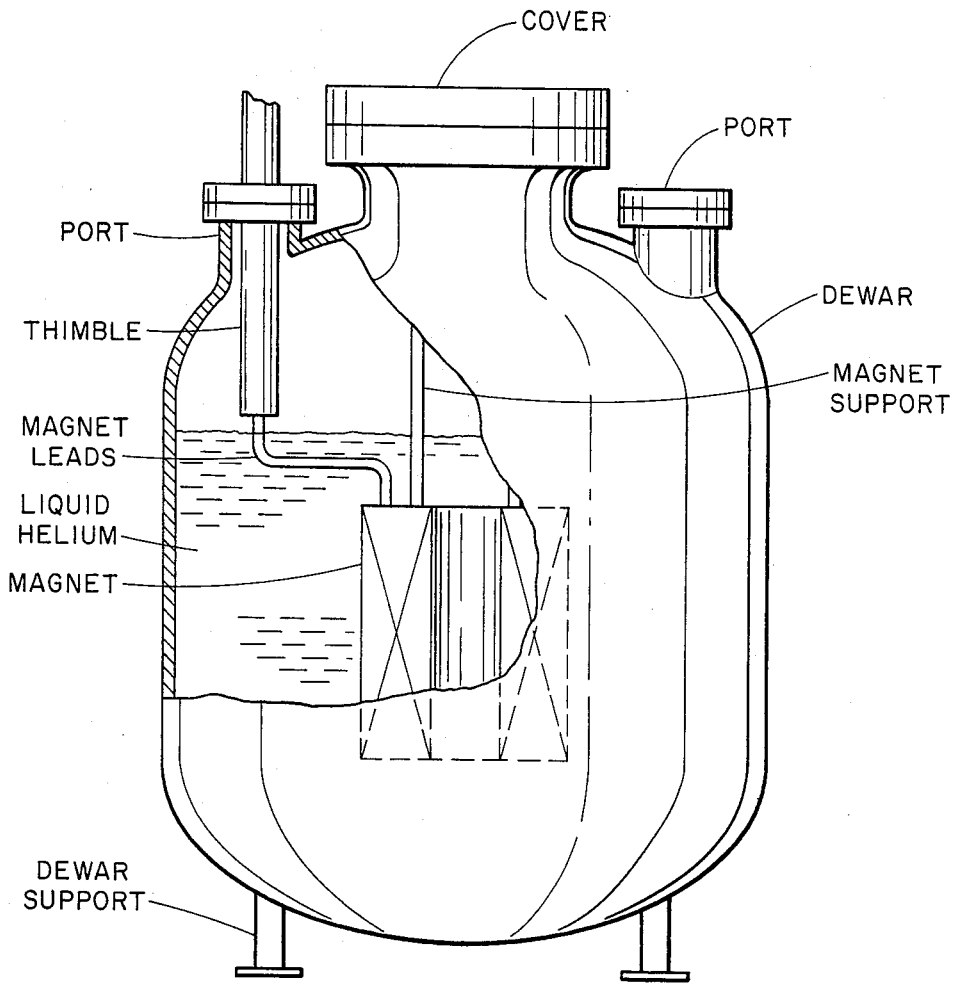
Fig. 1 PRIOR ART
FIG. 1 is a drawing, partly cutaway, to illustrate a typical superconducting magnet installation with which the present invention can be used.

Referring now to FIG. 1, shown therein is a typical superconducting magnet installation as might be used for experimental purposes. An insulated dewar of an appropriate configuration is used to contain a body of liquid helium. This helium, having a temperature of about 4.2 degrees Kelvin, permits a magnet to be operated in superconducting conditions. In this particular example the magnet is a hollow cylindrical type. It will be understood, of course, that magnets of other configurations are easily accommodated in such a dewar with either horizontal or vertical bores, and that many other types of superconducting magnet systems can be employed. Magnet leads are connected to the bottom of a thimble unit within which electrical contact is made for supplying current to the magnet. This thimble is inserted into the dewar through an appropriate port. The dewar is mounted on appropriate supports such as the legs shown. Other ports are typically provided for access to the interior of the dewar for experimental purposes, electrical leads, level indicators, and the like. The dewar is provided with an enlarged opening whereby the magnet, fastened to appropriate supports, can be lowered into the dewar and the cover properly secured. It may be seen in this figure that the lower end of the thimble is proximate the liquid helium and thus is maintained at the extremely low temperature required for superconductivity in a magnet. The portion removed from the dewar is at substantially room temperature which is in the order of 300 degrees Kelvin. All objects in contact with or near the liquid helium are fabricated from materials that minimize heat transfer in order to minimize any boiling off of the liquid helium. Typically, vapors of the helium are bled up through the thimble so that the materials within the thimble are maintained at as low a temperature as possible.

Figure 2:
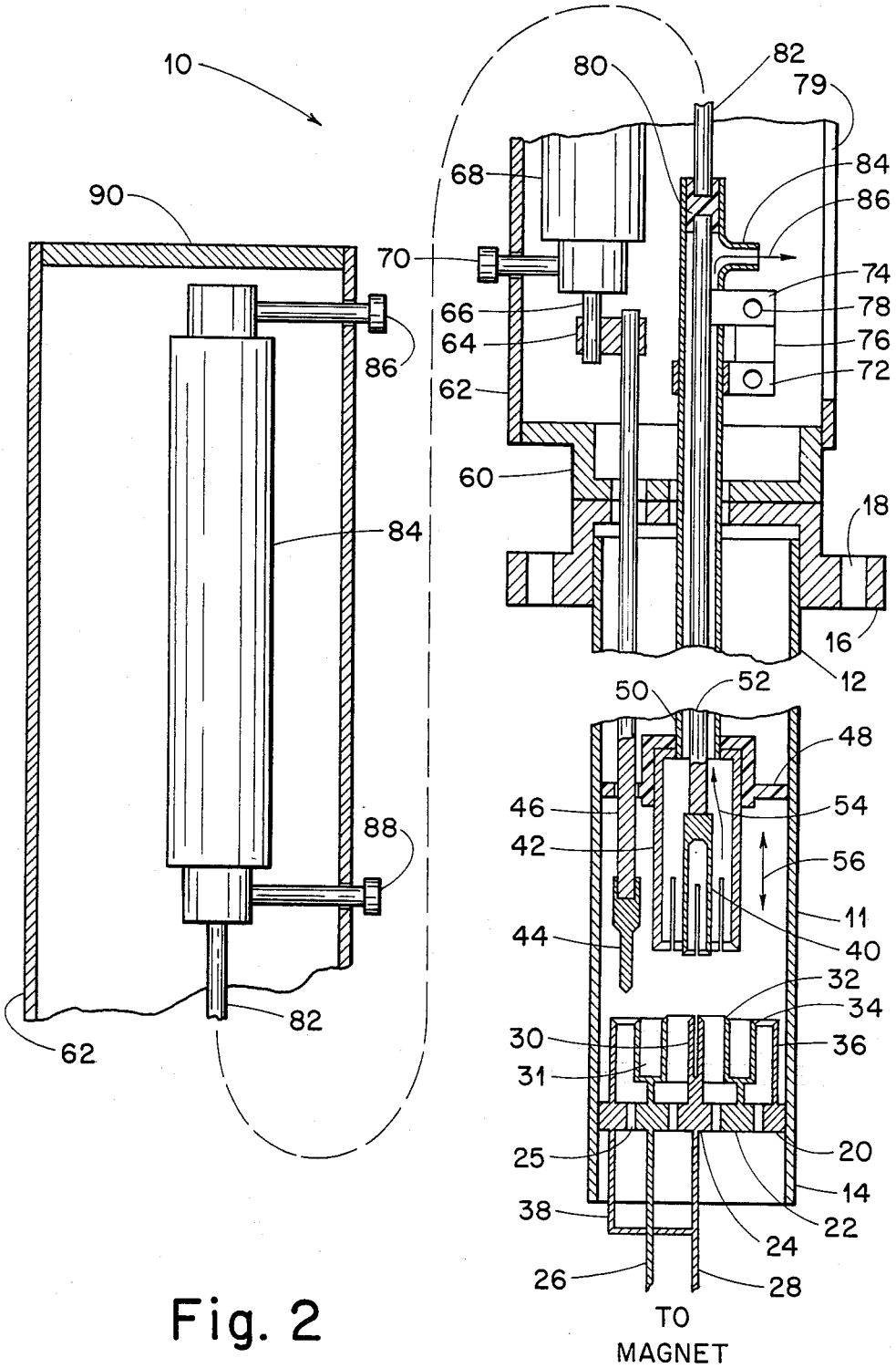
FIG. 2 is a fragmented drawing, primarily in section, illustrating the retractable current leads for a superconducting magnet and the pneumatic/hydraulic operators therefore.

Referring now to FIG. 2, shown therein generally at 10 is the unit for accomplishing the retraction of current leads to a superconducting magnet. A cylindrical housing 11, corresponding to the aforementioned thimble of FIG. 1, has an upper or first end 12 and a lower or further end 14 which during operation is substantially near liquid helium within a dewar. At the upper end 12 is a flange 16 provided with appropriate holes 18 for bolting the unit to the top of one of the ports of the dewar as shown in FIG. 1. Within the lower end 14 are a plurality of conductive rings 20, 22, and 24. These are electrically separated from each other by any suitable means such as concentric rings of insulation (not shown). A plurality of apertures 25 permit the flow of helium gas to the volume within the thimble 11.

Extending from the bottom of the thimble 11 are electrical leads 26, 28, which are the leads to the magnet as illustrated in FIG. 1. Mounted vertically from the central conductive ring 24 is a male plug member 30 which is electrically connected to lead 28. Surrounding this plug member 30 is an annular cup member 31 having upwardly directed lips 32, 34, for purposes described hereinafter. The cup member 31 is mounted from the conductive ring 22 and is electrically connected by the lead 26 to the magnet coil. Concentrically mounted with respect to the cup 31 is another annular electrode 36. This electrode is connected to lead 38 which, in turn, is joined to the electrical lead 28, which is also connected to the magnet coil.

Positioned above the aforementioned electrical contacts 30 and 32 are a pair of concentric cylindrical electrodes 40 and 42. Center electrode 40 is provided to contact the external surface of electrode 30, and electrode 42 is contoured to engage the exterior surface of electrode 32 of the cup 31. Both electrodes 40 and 42 can be provided with slots, as shown, so that some expansion can occur as these are brought into contact with the corresponding electrodes in the bottom of the thimble unit and thereby effect adequate electrical contact. Spaced radially from the concentric electrodes 40 and 42, is a shorting switch electrode or blade 44. The blade 44 is provided to engage the exterior surface of the electrode 34 as well as the inner surface of the cylindrical electrode 36 whereby an electrical short is produced between lead 38 and lead 26. When this short is made, there is a short effectively created between lead 26 and 28 for purposes described hereinafter. The shorting blade 44 is mounted upon the end of an axial movable rod 46, which is made of a low thermal conductivity material.

The concentric electrical contacts or electrodes 40 and 42 are mounted on a spacer 48 or other suitable unit which serves as a guide for these concentric elements as they are moved vertically (axially) within the thimble 11 as shown by the arrow 56. These contacts are moved an extended distance to reduce possibility of heat flow. The central electrode 40 is attached by any suitable means to an electrically conductive axial rod 52, and the outer concentric electrode 42 is connected by any suitable means to a concentric electrically conductive sleeve 50 within the thimble 11. The concentric relationship of the electrodes and their corresponding supports provides for an axial passageway such that helium vapors can flow upward through the unit as indicated by the arrow 54. This flow of helium vapor provides cooling to the electrode supports and thereby minimizes the heat loss along this channel.

Although concentric contacts and coaxial supports are shown in this FIG. 2, and may be preferred, many other configurations of contacts and supports can be used and are within the scope of the present invention.

Mounted to the top surface of the flange 16 is an additional flange 60. Flange 60 serves as a support for the lower end of a housing 62 which may be, for example, of square cross-section. Within this housing the aforementioned shorting switch rod 46 is fastened to a connector 64, having the other end thereof attached to the operator 66 of a pneumatic or hydraulic cylinder or actuator 68. One fluid connection to the cylinder 68 is indicated at 70. The cylinder 68 provides for an axial movement of a few centimeters (e.g., 2–3) of the blade 44.

Also within the housing 62 is the extension of the aforemention concentric current carrying supports 50 and 52. Attached to the electrically conductive tubing 50 is a lug 72, with a corresponding lug 74 attached to the central conductor 52. Lugs 72 and 74 are fastened to a support member 76, and each of the lugs is provided with an aperture 78 for the attachment of flexible electrical cables to each of the lugs (cables not shown). These cables, when connected to the lugs 72 and 74, pass through a slot 79 in the wall of the enclosure 62 and represent the power supply connections for the magnet. Supports 50 and 52 are spaced apart at their upper ends by an insulating bushing 80. Attached to this bushing, by any suitable means, is an operator rod 82. A port 84 is provided in the conductive tube or sleeve 50 near the bushing 80 such that helium vapor outflow is permitted as indicated by the arrow 86.

The operator rod 82 is the equivalent of the piston rod within a pneumatic/hydraulic cylinder or actuator 84. This cylinder 84 is provided with conventional inlet and outlet lines as at 86 and 88. The cylinder is mounted within the housing 62 by any suitable means near the top thereof, and the top of the housing is closed with a cover 90.

From this figure it may be seen that cylinder 68, through its operator rod 66 and the rod 46, provides for axial movement of the rod 46 and thereby the movement of the shorting switch blade 44 into contact with or out of contact with electrodes 34 and 36 in the base of the thimble 11. In a similar manner, operation of the cylinder 84 provides for axial movement of the contacts 40 and 42 so that electrical contact can be made or broken with regard to the contacts 30 and 32 in the base of the thimble.

Figure 3:
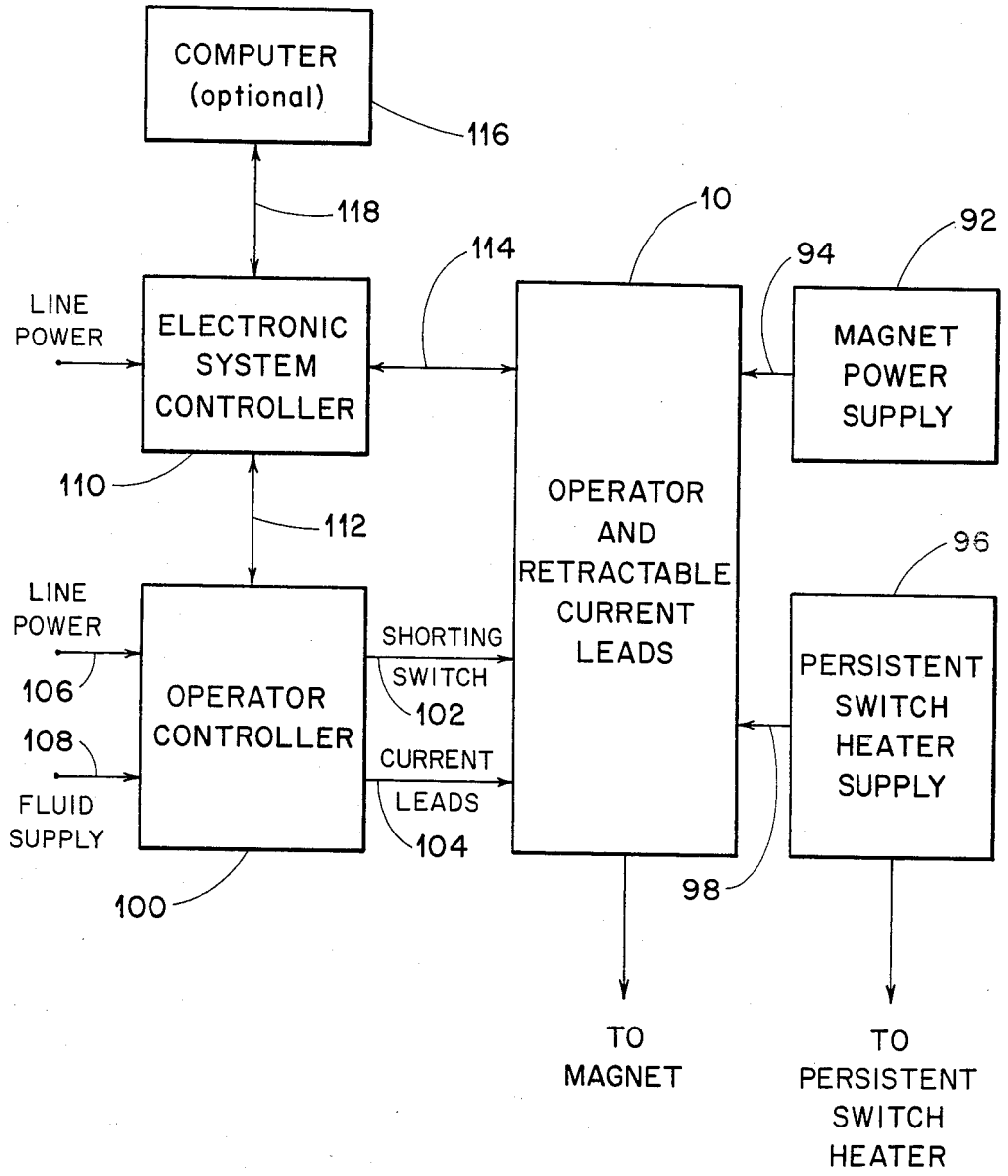
FIG. 3 is a block diagram of the present invention illustrating components used with the apparatus of FIG. 2.

Referring now to FIG. 3, shown therein is a block diagram of the present invention. Shown in the center of this figure is the operator unit 10 as described in connection with FIG. 2. A magnet power supply 92 is connected to the operator 10 using appropriate cables 94 attached at lugs 72 and 74. A second power supply, identified as the persistent heater switch supply 96, is connected through appropriate leads 98 to the operator unit 10. The purpose of the persistent switch heater supply will be described hereinafter. An operator controller 100, which is for either a pneumatic system or a hydraulic system, is connected to the operator unit 10 through two different connections: connection 102 for the shorting switch operator, and connection 104 for the current leads operator; both of which are pneumatic or hydraulic lines. This operator controller is provided with line voltage through lead 106, and the required supply of air or hydraulic fluid through line 108.

The operator controller 100 is physically located remotely from the operator 10 in order to isolate the magnet from any magnetic elements or magnetic field producing elements.

Also required for the present invention is an electronic system controller 110. Typically this is a microprocessor (e.g., INTEL, Model 8085) along with appropriate interface units such as input/output ports (e.g., INTEL, Model 8255). This controller 110 provides information to the operator controller through line 112 and receives back appropriate signals therefrom. Circuitry employing microprocessors and interface units for the controller 110 is well known by persons versed in the art. Signals between the electronic system controller and the operator 10 are provided by lead 114. In order for the system to be routinely operated or operated under some control other than by an individual, a computer unit 116 is optional in this invention. This is connected to the system through lead 118.

A description of the operation of the present invention can be understood by referring principally to FIG. 2 in conjunction with FIG. 3. When it is desired to initiate operation of the superconducting magnet using the present invention, the cylinder 84 is operated using an appropriate circuitry and switching in the operator controller to cause the operator rod 82 to be driven in a downwardly direction. This brings about engagement of the concentric electrodes 40 and 42 with their respective electrodes 30 and 32 in the lower portion of the thimble 11. Thereafter, the magnetic power supply is put into operation to direct current through the leads 94 and thence through the concentric conductive members 50 and 52, whereby this current flows through leads 26 and 28 to the magnet. During this period of time, power is also supplied from the persistent switch heater supply such that electrical current flows (connections not shown) through a short element within the magnet, which segment would be a superconductor in the absence of the flow of this current. Power flow is continued until it is determined that the persistent mode of the magnet is desired, namely that the magnet is at a fully superconductive state and charged to the desired magnet field. At this point, the current to the persistent switch is interrupted and the persistent switch becomes a superconductor allowing the current to continuously flow in the magnet coil windings through the persistent switch shorting the magnet leads.

When the persistent mode is achieved in a superconducting magnet, a signal is transmitted through leads 98 and 114 to initiate automatic operation through the electronic system controller 110. The operator 68 is then caused to drive the shorting blade 44 into contact with the electrodes 34 and 36 to thereby short the external leads of the magnet unit. This is carried out after current flow from the magnet power supply 92 is turned off. This switch unit, when closed, parallels the persistent switch of the magnet thereby preventing damage to the persistent switch if the magnet quenches. It also prevents the dumping of inductive energy into the magnet leads. With the shorting blade 44 in position, the operator unit 84 is operated to move in the opposite direction and thus disconnect the current leads at the aforementioned contacts 40 and 42, and 30 and 32. With these leads sufficiently retracted, any heat conduction path to the dewar from external equipment is minimized and thereby the boil off of helium within the dewar is minimized.

Voltages across these various contacts and signals proportional to current flow are monitored, using means known in the art, by the electronic system controller. These signals are used to provide either a "go" or a "stop" signal so that the unit cannot operate in an unsafe manner. For example, if the voltage drop between the disconnect unit when the contacts are otherwise brought together becomes excessive, the unit will be shut down. Such high resistance across the contacts would otherwise cause excessive boiling of the liquid helium and thereby be damaging to the system. As an additional safety feature, the cylinder 84 cannot be operated until the system is assured that there is no current flow from the magnet power supply. Other protective signals are derived from the air/hydraulic fluid supply such that the system would be inoperable if this supply should fail. The same is true of a failure of the line power to the system.

The various operations of these devices can be initiated by personnel when appropriate signals are received. However, in many applications it may be desirable that the movement of the current leads from a non-retracted to a retracted position be accomplished according to some particular time sequence or other sequences associated with the operation of the magnet. Accordingly, the apparatus can be controlled by a program introduced into the computer unit 116 shown in FIG. 3. Under these conditions, any desired operational sequence can be performed as may be necessary or desirable for a particular operation of the magnet.

From the foregoing, it may be seen that the operation of a retraction system is accomplished by apparatus which does not generate a magnetic field which might be detrimental to the field produced by the superconducting magnet. The apparatus can be constructed of non-magnetic materials to further prevent any magnetic interference. Significant numbers of safety checks are built into the apparatus to minimize any potential hazard associated with energizing a superconducting magnet and then disconnecting the leads thereto. In addition, all of the operating controllers can be well removed from the region of the superconducting magnet. This is particularly true when the magnet is used in an area where intense radiations are produced either through induced radiation or radiation produced by reactions carried out in the presence of a magnet.

Although the device has been described for the automatic retraction of the current leads to a superconducting magnet, the device has application in other fields where electrical contact is to be made in an automatic, safe and possibly remote manner.

It is, of course, understood that although a preferred embodiment of the present invention has been illustrated and described, various modifications thereof will become apparent to those skilled in the art. Accordingly, the scope of the invention should only be defined by the appended claims and the equivalents thereof.

We claim:

1. A system for automatically and safely retracting current leads feeding current to a superconductor magnet operating in an environment at a selected temperature and in a persistent mode, which comprises:

an elongated hollow thimble unit for being immersed in such environment of such magnet, said thimble unit being fabricated of a material of low thermal conductivity and having a first end maintained at substantially such selected temperature, and a further end;

a first pair of magnet current contacts mounted within said first end of said thimble unit, each contact of said pair connected to a separate electrical lead to such magnet;

a further pair of magnet current contacts within said thimble each proportioned to engage respective of said first pair of magnet current contacts, said second pair of magnet current contacts adapted for axial movement along said thimble from a position of contact with said first pair to a position removed from such environment of such magnet;

a first fluid operated means connected to said further pair of magnet current contacts to effect said axial movement;

means for delivering electrical current to said further pair of magnet current contacts;

means for sensing such persistent mode of such magnet; and means for initiating operation of said fluid operating means when said persistent mode is sensed to separate said further pair of magnet current contacts from said first pair and remove said further pair from such environment.

2. The system of claim 1 wherein:

said first pair of magnet current contacts is a pair of concentric annular contacts insulated from each other;

said further pair of magnet current contacts is a pair of concentric annular contacts insulated from each other and proportioned for electrical contact with said first pair of magnet current contacts;

said first fluid operated means includes a coaxial pair of non-contacting rigid conductive support members attached to said further pair of magnet current contacts and a first fluid operated cylinder external to such magnet environment connected to said conductive members for effecting said axial movement of said further pair of magnet current contacts within said thimble unit; and said means for delivering electrical current to said further pair of magnet current contacts is a pair of cable lugs attached to individual of said conductive support members proximate an end opposite said magnet current contacts.

3. The system of claim 1 further comprising:

a magnet shorting switch contact mounted within said first end of said thimble unit proximate one of said first pair of magnet current contacts;

a shorting switch blade mounted within said thimble unit for effecting electrical contact between said magnet shorting switch contact and said one of said first pair of magnet current contacts, said shorting switch blade adapted for axial movement within said thimble unit;

a further fluid operating means connected to said shorting switch blade to effect said axial movement of said shorting switch blade; and means for initiating operation of said further fluid operating means.

4. The system of claim 3 wherein:

said first pair of magnet current contacts is a pair of concentric outer and inner annular contacts insulated from each other;

said magnet shorting switch contact is an annular contact encircling said first pair of magnet current contacts and insulated from said magnet current contacts;

said shorting switch blade is proportioned for making contact between said shorting switch contact and said outer annular contact of said first pair of magnet current contacts; and said further fluid operating means includes a rigid member supporting said shorting switch blade and a further fluid operated cylinder external to such magnet environment connected to said member supporting said shorting switch blade for effecting axial movement of said shorting switch blade within said thimble unit.

5. The system of claims 2 or 4 wherein said first and further fluid operated cylinders are hydraulically operated cylinders.

6. The system of claims 2 or 4 wherein said first and further fluid operated cylinders are pneumatically operated cylinders.

7. The system of claim 3 wherein said first and further fluid operating means includes a fluid controller interposed between a source of fluid and said first and further fluid operating means, said fluid controller operated by signals generated by said means for sensing such persistent mode of such magnet.

8. The system of claim 2 wherein such environment of such magnet is a pool of liquid helium, and wherein vapor generated from said pool of liquid helium is directed between said concentric annular contacts of said first and further pair of magnet current contacts and between said coaxial pair of conductive support members and is vented proximate said cable lugs.

9. The system of claim 7 wherein said fluid controller is connected to and receives signals from an electronic system controller monitoring for such persistent mode.

10. The system of claim 9 wherein said electronic system controller is connected to and operated by a computer, and said computer is controlled by a suitable program to effect such retraction of such current leads under preselected operating conditions of such system and such magnet.

11. The system of claim 9 further comprising:

means for monitoring a voltage drop between said first pair of magnet current contacts and said further pair of magnet current contacts and for generating a signal within said electronic system controller related to said voltage drop;

means for generating a signal within said electronic system controller corresponding to a condition of said source of fluid for said fluid controller;

means for generating a signal within said electronic system controller corresponding to a voltage drop between said magnet shorting switch contact and said one of said first pair of magnet current contacts as effected by said shorting switch blade;

whereby said electronic system controller initiates functioning of said fluid controller for operation of said first and further fluid operating means only under conditions of functioning of said fluid source, absence of current flow through said magnet current contacts and the closure of said shorting switch.

12. A system for automatically and safely retracting current leads feeding current to a superconductor-type magnet operating within a pool of liquid helium or the like, after a persistent mode is achieved, so as to minimize heat flow into such pool, which comprises:

an elongated thimble unit fabricated from a material of low thermal conductivity, said thimble unit having a first end proximate said pool and a further end substantially removed from said pool;

a first pair of concentric annular inner and outer magnet current contacts mounted within said first end of said thimble unit, said inner and outer contacts insulated from each other and each electrically connected to such magnet;

an annular shorting switch contact mounted within said first end of said thimble unit concentric with said outer contact of said first pair of contacts electrically connected to said inner contact and insulated from said outer contact;

a further pair of concentric annular magnet current contacts within said thimble unit proportioned for current carrying engagement with respective of said first pair of magnet current contacts and adapted for axial movement within said thimble unit from a position of engagement with said first pair of magnet current contacts to a position substantially removed from said first pair of magnet current contacts;

a shorting switch blade within said thimble unit axially from a position joining said shorting switch contact to said outer magnetic current contact for shorting such magnet to a position removed from said shorting switch contact;

a pair of coaxial current conductive support members each having a first end attached to respective of said contacts of said further pair of magnet current contacts and a further end, said support members insulated from each other;

individual current cable lugs attached to each of said support members proximate said further ends for attachment to a magnet power supply;

a first fluid-operated cylinder attached to said further ends coaxial support members for effecting axial movement of said coaxial support members to effect axial movement of said further pair of magnet current contacts;

a switch blade support member having a first end attached to said shorting switch blade and a further end;

a further fluid-operated cylinder attached to said further end of said switch blade support member for effecting axial movement of said switch blade support member for effecting movement of said shorting switch blade relative to said shorting switch contact;

a fluid controller interposed between a source of fluid and said first and further fluid operated cylinders;

signal generating means for producing signals corresponding to such persistent mode of such magnet, operability of said source of fluid, position of said shorting switch blade, and absence of current flow from said magnetic power supply;

an electronic system controller for receiving signals from at least said signal generating means and for processing said signals to produce an output signal to said fluid controller for effecting automatic and safe retraction of such current leads to such magnet.

* * * * *